United States Patent [19]

Leisi

[11] Patent Number: 4,635,850

[45] Date of Patent: Jan. 13, 1987

[54] SPRAY NOZZLE, PARTICULARLY ADAPTED FOR SPRAY GUNS

[75] Inventor: Marcel Leisi, Thonex, Switzerland

[73] Assignee: Exit S.A., Switzerland

[21] Appl. No.: 728,811

[22] Filed: Apr. 29, 1985

[30] Foreign Application Priority Data

Apr. 27, 1984 [CH] Switzerland ..... 2064/84

[51] Int. Cl.[4] ..... B05B 1/12; B05B 15/02

[52] U.S. Cl. ..... 239/119; 239/288.3; 239/391; 239/600; 251/309; 285/273

[58] Field of Search ..... 239/119, 288, 288.3, 239/288.5, 390, 391, 393, 600; 251/309, 314; 285/261, 273

[56] References Cited

U.S. PATENT DOCUMENTS

| | | | |
|---|---|---|---|
| 3,955,763 | 5/1976 | Pyle et al. | 239/119 |
| 4,165,836 | 8/1979 | Eull | 239/119 |
| 4,484,707 | 11/1984 | Calder | 239/288.3 X |

*Primary Examiner*—Andres Kashnikow

*Attorney, Agent, or Firm*—Ostrolenk, Faber, Gerb & Soffen

[57] ABSTRACT

The nozzle of the invention comprises a rotary element placed within a central body and traversed by a channel having a spray orifice, a safety tip placed on the front of the nozzle and an adapter placed between the central body and the diffuser of the spray gun. The seal between the nozzle and the diffuser is provided by a joint, the front part of which has ribs introduced into corresponding grooves in the rotary element to assure appropriate positioning.

19 Claims, 4 Drawing Figures

SPRAY NOZZLE, PARTICULARLY ADAPTED FOR SPRAY GUNS

BACKGROUND OF THE INVENTION

The present invention is directed to a spray nozzle, particularly adapted for spray guns. The invention comprises a rotary element placed within a central body. The rotary element is traversed by a channel having a spray orifice. A safety tip is arranged at the front of the central body between the rotary element and the diffuser of the gun. The spray gun is provided with a diffuser on which the central body is secured. The central body has a central bore corresponding to the channel of the spray orifice of the rotary element. A fluid tight joint structure traverses the bore in the central body.

There are a large number of so-called safety spray nozzles. They are provided at their front with a tip to protect against contact of the user with the fluid sprayed, at least over a relatively short distance in front of the spray orifice. The spray particles emerge from the spray orifice at very high speed since spray nozzles of this type are generally used for the spraying of paint under high pressure. Spray nozzles of this type must, therefore, be and remain tight after repeated rotations of the rotary element in the central body and after numerous diassemblies required for cleaning or for changing the atomizer and, therefore, changing the rotary element.

The principal problem raised by these nozzles which are intended to operate under high pressure is to obtain sufficient tightness of the seal without using excessive clamping force.

Furthermore, the rotary element and its atomizer must be capable of being easily changed.

The prior art has suggested various solutions to these problems but have not solved them: U.S. Pat. No. 3,955,763 describes a spray nozzle intended to be fastened to the diffuser of a spray gun, the nozzle comprising a rotary element in the form of a ball having a spray orifice provided in a circular conduit. This nozzle comprises a housing surrounding the rotary element and a sealing member placed in the housing and applying itself tightly against the rotary element. The housing, the rotary element and the sealing member are assembled in a single operation by screwing onto the diffuser of the spray gun. When the user desires to change a nozzle, he must separate the nozzle from the diffuser of the gun and then assemble the different parts before proceeding in a single operation, with the remounting of the nozzle on the diffuser of the gun. The user may encounter difficulties in this operation since the parts constituting the nozzle must be in perfect registry with each other before proceeding with the clamping of the nozzle.

U.S. Pat. No. 4,165,836 describes a rotary spray nozzle comprising a cylindrical rotary element and a sealing joint intended to prevent leakage of fluid under high pressure. It comprises a metal bearing member which bears against the rotary element and a spaced elastic element clamped between the metal bearing element and the diffuser of the spray gun in order to form a fluid joint and at the same time assure the operation of a damper which protects the metallic bearing element from excessive clamping forces.

The nozzle described in U.S. Pat. No. 4,165,836 has the same drawbacks as the nozzle described in U.S. Pat. No. 3,955,763. U.S. Pat. No. 4,484,707 describes a spray nozzle which contains an orifice member disposed within a channel in a housing body. This design permits easy substitution of different sized orifice members. Moreover, the disclosed rotary element can be rotated to reverse the orifice for cleaning. Furthermore, the clamping nut of the nozzle is integral with the latter and cannot be changed. This nozzle is, therefore, intended to be mounted on a single type of gun and thus cannot be used on all existing guns.

SUMMARY OF THE INVENTION

The object of the present invention is to provide a spray nozzle, the rotary element of which, together with its atomizer, can be cleaned or changed without difficulty in a single operation. Furthermore, the nozzle can advantageously be placed, due to a set of adapters, on any type of standard gun existing on the market. Upon the removal or change of the rotary element and its atomizer, the rear part of the nozzle will remain integral with the diffuser of the gun so that, upon the cleaning or replacement thereof, the user will have a gun provided with a nozzle complete with its safety system. The danger for the user of having a gun under pressure with a bare diffuser is thus avoided.

The spray nozzle of the invention is characterized by the fact that the rotary element has at least one circular groove, the axis of which corresponds to the axis of rotation of the element, into which groove there is introduced a corresponding rib of the sealing joint, and by the fact that the front part of the joint has a cross-section of a shape corresponding to that of the bore of the central body, so that the joint is guided, positioned and held by the bore.

The bore of the central body will advantageously have a circular cross-section interrupted by two straight lateral parts which are parallel to each other and the joint will have a front facing portion which snugly rests against the rotary element and a front circular cross-section having two parallel lateral millings corresponding to the lateral parts of the bore of the central body. The rotary element may have two circular grooves parallel to each other and located on opposite sides of the channel having the spray orifice, the joint having two corresponding ribs placed on opposite sides of the opening of its central bore, the two ribs forming an angle of 90° with the two lateral millings for the guiding, positioning and holding of the joint.

In accordance with a preferred embodiment, the rotary element is integral with a key intended to turn it in the central body. An adapter can be interposed between the central body and the diffuser of the gun. The adapter is screwed onto the gun and has a tubular free part introduced into the borehole of the central body which is screwed onto the adapter by means of a removable nut. The base of the joint is pressed against the gun by the adapter and the joint passes through the tubular part of the adapter and the bore of the central body so as to rest against the rotary element.

The spray nozzle will advantageously comprise a set of removable adapters, each having an inner thread which corresponds to the different standard thread of the existing guns.

In accordance with a preferred embodiment of the invention, the joint is made in two parts, one sliding in the other, tightness being assured by an O-ring placed between these two parts. One of the parts—the seat—is clamped between the adapter and the diffuser of the gun. The other part—the front part—slides on a tubular projection of the seat and passes through the cylindrical part of the adapter and the bore of the central body.

The tubular projection of the seat may be integral with the seat or be a metal piece onto which the seat is applied.

The tubular projection of the seat may have grooves extending over about one-half of its front part.

The spray orifice placed in the channel of the rotary element can be machined in an atomizer which is in the form of a driven stud in the channel against a shoulder provided in said channel and held by a clamping ring.

The spray nozzle will preferably comprise a set of rotary elements together with its key, each element having a spray orifice defined by a predetermined rate of flow and spray angle.

The joint may consist of nylon reinforced with carbon fibers.

The rotary element may be in the form of a cylinder.

Other features and advantages of the present invention will be apparent from the following description of preferred embodiments and the accompanying drawings.

DESCRIPTION OF THE PREFERRED EMBODIMENTS

Figure 1:
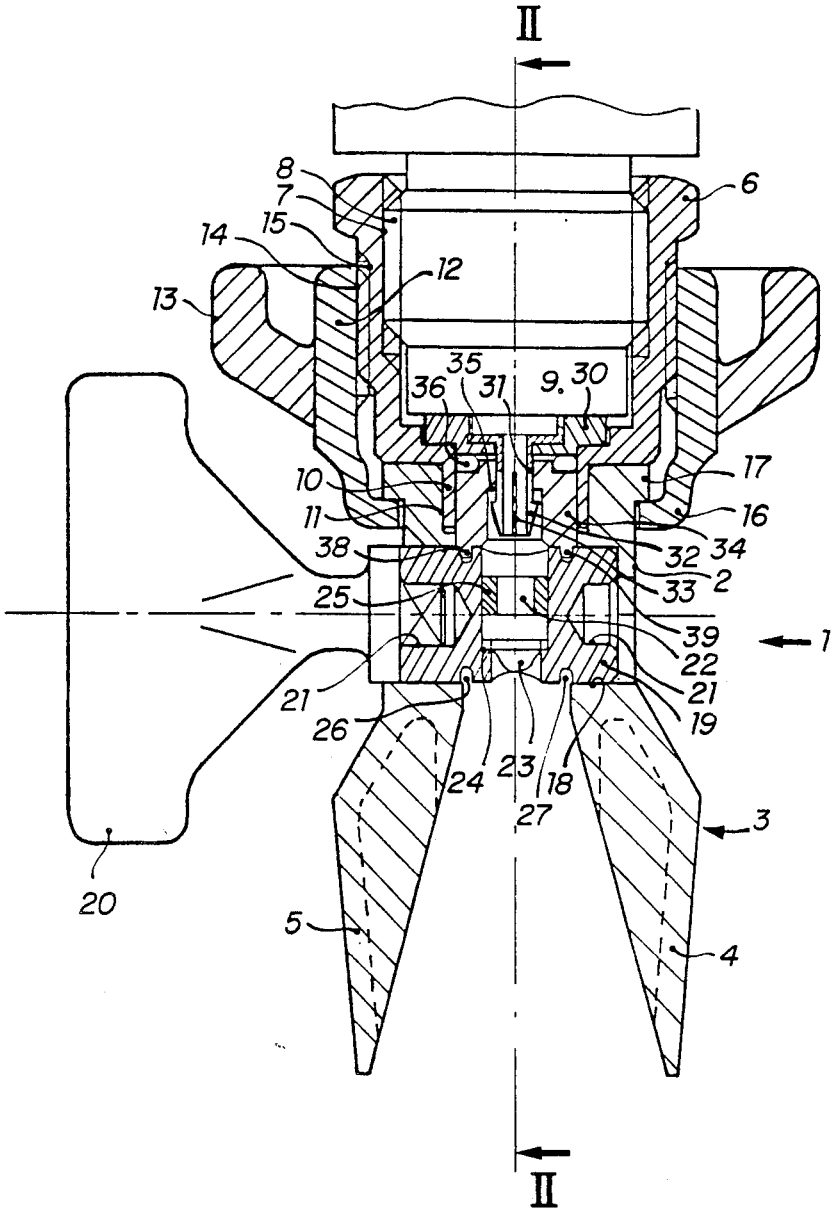
FIG. 1 is a longitudinal section through the spray nozzle along the axis of rotation of the rotary element.
Figure 4:
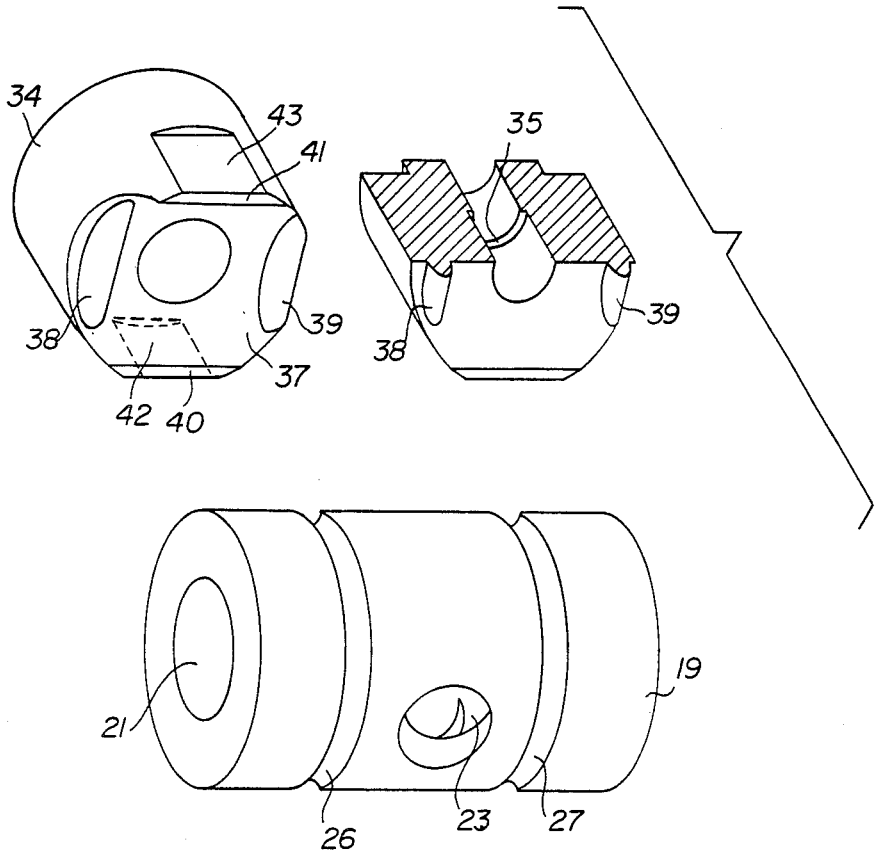
FIG. 4 is a view in perspective of the rotary element with its atomizer and the front part of the joint.

The spray nozzle 1 shown in FIGS. 1 and 4 comprises a central body 2, a safety tip 3 formed of two parts 4 and 5 placed in front of the central body 2 and an adapter 6 placed at the rear of the body 2. The adapter 6 is in the form of a nut with an inner thread 7 which screws onto the thread 8 of the cylindrical diffuser 9 of the spray gun (not shown). The nut of the adapter 6 has, at its front, a tubular part 10 which is introduced into a corresponding bore 11 in the central body 2. The adapter 6 and the central body 2 are held together by a removable nut 12 having tightening wings 13. The removable nut 12 has on its inside a thread 14 which screws onto a corresponding thread 15 developed in the periphery of the adapter 6. The removable nut 12 has a front curved portion 16 which rests against a shoulder 17 on the central body 2. By screwing the wing nut 12 onto the adapter 6, the central body 2 is brought towards the adapter 6 and by loosening the wing nut 12, the central body is permitted to move away from the adapter 6, sliding on the tubular part 10.

Figure 3:
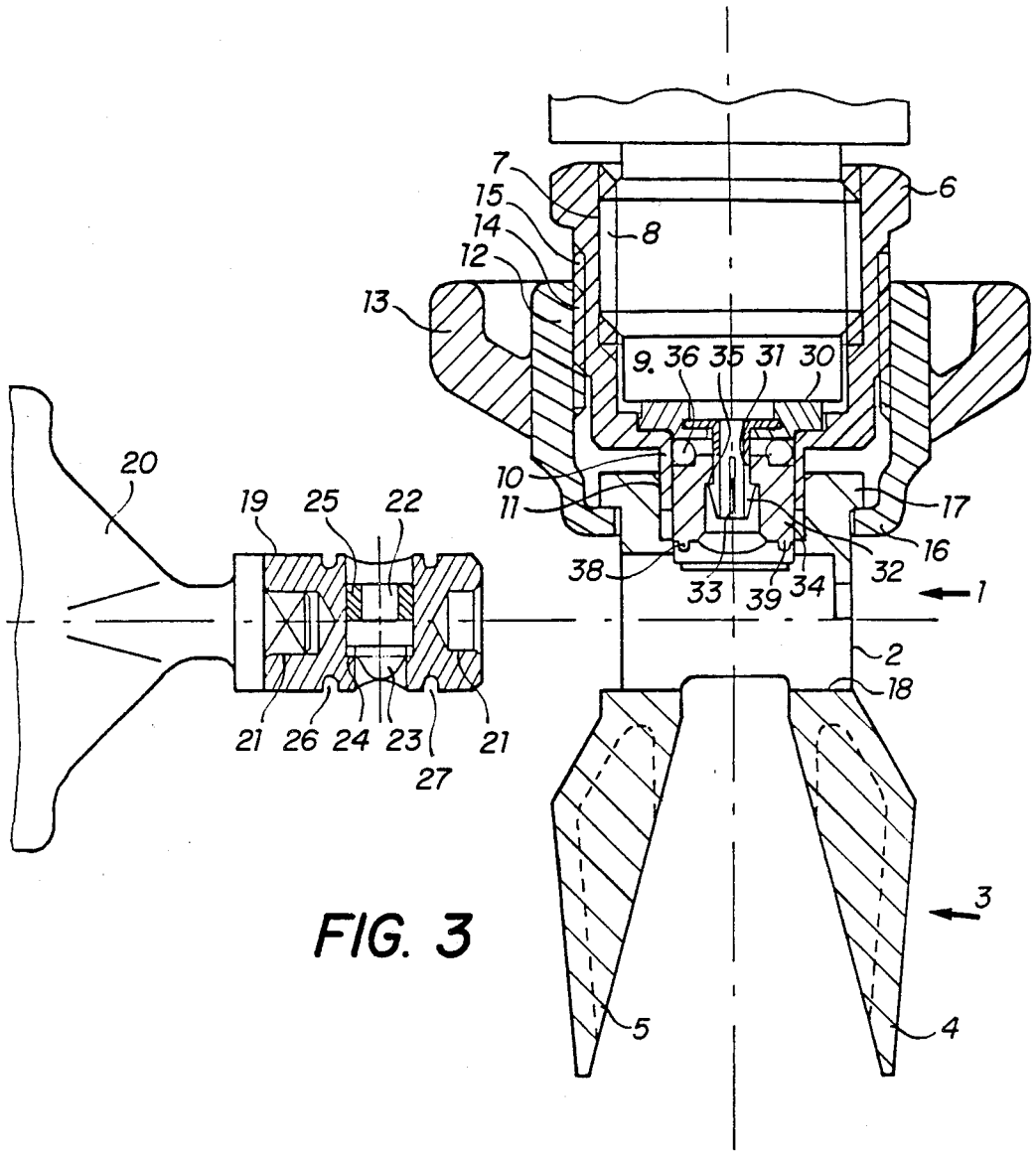
FIG. 3 is a longitudinal section through the spray nozzle identical to the section of FIG. 1, the rotary element and its key having been removed.

The central body 2 has a vertical bore 18 into which there is introduced a rotary cylinder 19 surmounted by a key 20 which is integral with the cylinder. The key 20 is force-fitted into a bore 21 in the cylinder 19 and makes it possible to turn the cylinder in its cylindrical housing 18. The cylinder 19 has a bore 21 at each of its ends, as shown in FIGS. 1 and 3. The cylinder 19 has a transverse channel 22 into which an atomizer 23 is introduced. The atomizer 23 rests against a shoulder 24 of the channel 22 and is made tight relative to said channel by a nylon joint (not shown). It is held against the shoulder 24 by a clamping ring 25. Two grooves 26 and 27 are positioned on opposite sides of the spray channel 22 in a plane perpendicular to the axis of the cylinder 19. The grooves 26 and 27 will serve to receive corresponding ribs of a sealing joint placed between the diffuser 9 of the gun (not shown) and the cylinder 19.

The sealing joint placed between the diffuser 9 of the gun (not shown) and the cylinder 19 surmounted by its key 20 comprises several parts. This joint comprises, first of all, a seat 30 clamped between the diffuser 9 of the gun and the adapter 6. This seat 30 surrounds the base of a tubular projection 31 terminating in a frusto-conical part 32 which will serve as stop for the front part of the joint described below. The front end of the piece 31 has slots 33 intended to assure better flow of the liquid. The piece 31 is forced into the central bore of a front part 34 of the joint shown in perspective in FIG. 4.

As mentioned above, the seat of the joint 30 and the tubular projection part 31 may be two separate pieces. The joint 30 is made of nylon reinforced with carbon fibers and the piece 31 is made of metal. As a variant, the seat 30 of the tubular projection piece 31 can be made in a single piece. The material used in this composite structure can preferably be nylon reinforced by carbon fibers. As mentioned above, the tubular projection piece 31 is forced into the front part 34 of the joint, which may be made of nylon. The shoulder formed by the conical front part 32 of the piece 31 will serve as stop for the front part of the joint 34 due to the corresponding shoulder 35 provided in the joint 34. The seal between the seat 30 of the joint and its front part 34 will be assured by means of an O-ring 36.

The front part of the joint 34 has a front surface 37 formed in a manner to correspond to the surface of the cylinder 19 (see also FIG. 4). This front surface 37 has two ribs 38 and 39 intended to be introduced into the grooves 26 and 27 of the cylinder 19. In view of the configuration of the cylinder 19 and its position, the front part of the joint 34 has two lateral flanks 40 and 41. Straight millings 42 and 43 are made on the outer part of the flanks 40 and 41. The millings 42 and 43 define two opposite parallel flat surfaces on the cylindrical periphery of the front part 34 of the joint. The millings 42 and 43 bear against corresponding parts 44 and 45 of the bore of the central body 2 (see FIG. 2). The front part of the joint is thus held in the central body and the joint cannot turn in the bore of the central body. The straight parts 44 and 45 serve thus as guide and reinforcement for the front part 34 of the joint. The ribs 38 and 39 of the front part 34 of the joint which are to be introduced into the grooves 26 and 27 of the cylinder also serve as reinforcement and guide for the front part 34 of the joint, which is thus held, guided and supported on its four sides. Due to the ribs 38, 39 and their corresponding grooves on the cylinder 26 and 27, as well as the flat parts 44 and 45 of the central part 2, as well as these corresponding millings 42 and 43 on the joint, the latter will be guided and held and can preferably be made of a material such as nylon. It will thus assure a good seal with the cylinder 19 without it being necessary to have recourse to large clamping forces.

Figure 2:
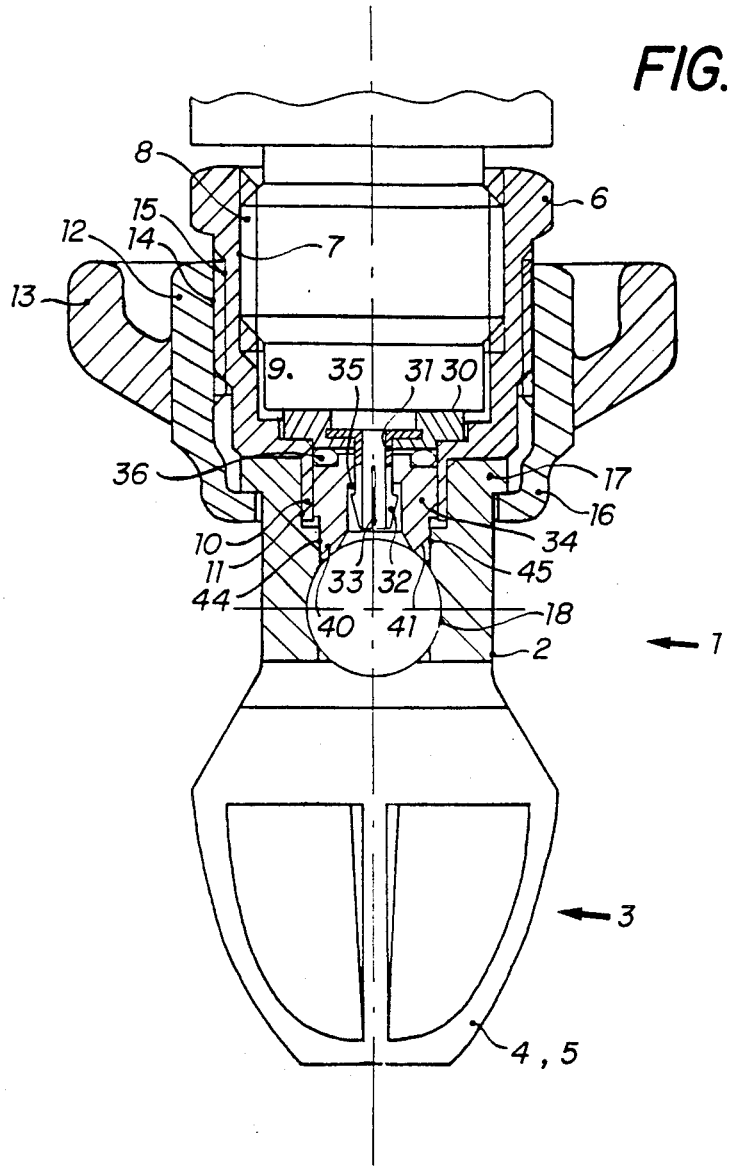
FIG. 2 is a longitudinal section through the spray nozzle along the line II—II of FIG. 1.

The spray nozzle which has just been described with reference to FIGS. 1 and 2 is mounted on the diffuser of a high-pressure gun and operates as follows:

As mentioned above, the seat of the joint 30 is clamped between the adapter 6 and the diffuser 9 of the high-pressure gun. The nozzle will be delivered with a set of adapters 6 and the user will, therefore, first of all select the proper adapter based on the type of diffuser which his spray gun has. Since the adapter 6 is in the form of a nut, the tightening of the joint 30 will be easy. Before effecting this tightening, the user will have put the complete joint in position in the adapter, that is to say the seat 30 with its projection piece 31, the front part of the joint 34 and the O-ring 36. The adapter having been screwed onto the thread 8 of the diffuser 9 of the spray gun, it will be necessary merely to unscrew it, and all operations of unplugging the atomizer and cleaning and changing the atomizer—the last operation consisting in changing the cylinder 19 and its key 20—can be carried out without the adapter 6 being manipulated.

As soon as adapter 6 is in position with its complete joint, the central body 2, provided with its cylinder 19 surmounted by the key 20, is introduced onto the tubular part 10 of the adapter 6. Upon this introduction, the user will be careful to position the front part 34 of the joint in such a manner that the ribs 38 and 39 enter into the corresponding grooves 26 and 27 of the cylinder 19 and in such a manner that the millings 42 and 43 of the front part of the joint slide on the corresponding parts 44 and 45 of the central body 2. When the joint is in place, it will then be sufficient to screw the removable nut 12 on the adapter by means of the wings 13. When all the pieces consituting the nozzle are in place, it will be sufficient to lock the nut 12 in such a manner that the O-ring 36 is compressed between the two pieces consituting the joint, that is to say the seat 30 and the front part 34. The final operation consist in turning the cylinder into the position shown in FIG. 1, whereupon the gun with its spray nozzle is ready for use. The placing in operation of the gun consists in withdrawing a needle (not shown) which rests against a bore (not shown) provided at the end of the diffuser 9 and the liquid passes through the central bore of the projection piece 31, emerges from its free end and from the slots 33, and arrives in the transverse channel of the cylinder 19 and then finally in the atomizer 23. Tightness is assured between the diffuser 9 and the adapter 6 by the seat 30 of the joint and between the cylinder 19 and the front part 34 of the joint by the face surface 37 of the said front part 34. Despite the strong pressure between these two pieces, the ribs 38 and 39, as well as the supports 44 and 45 of the central body 2 which supports the side flanges 40 and 41, prevent all deformation of the joint and assure perfect tightness.

The nozzle delivered with several cylinders 19 is preferably equipped with different atomizers. The complete set consists of about 150 cylinders provided with atomizers 23 having different orifices which permit setting the rate of flow and different spray angles. When it is desired to change the atomizer, a suitable cylinder is selected by the user. In order to change cylinder 19, the user will unscrew the nut 12 to move the central body 2 slightly away from the adapter 6. It will be sufficient to loosen this screw by about one turn in order for the rib 38 and 39 to emerge from the corresponding grooves of the cylinder 26 and 27. When the ribs 38 and 39 have emerged from the corresponding grooves 26 and 27 of the cylinder 19, the lateral millings 42 and 43 are still in engagement with the corresponding support parts 44 and 45 of the central body 2 so that the front part 34 of the joint remains in position relative to the central body. It is sufficient then to remove the cylinder by grasping it by the key 20, as shown in FIG. 3, and to introduce the new cylinder 19. The user need not observe any particular precaution for this operation. It is sufficient to introduce the cylinder 19 into the corresponding bore of the central body, applying it against the bottom of said bore. As soon as the cylinder is in the bore, it is sufficient to turn the nut 12 about one turn in order for all the pieces constituting the nozzle to come into position.

It will be readily understood that for any change of cylinder, the entire nozzle remains in place on the diffuser of the gun. This fact is important for obvious reasons of safety. Furthermore, the user need take no precaution relative to the positioning of the joint upon change of the cylinder since the front part of the joint 34 remains in position relative to the central body 2 due to the millings 42 and 43 and their corresponding bearing surfaces 44 and 45 (FIG. 2).

The cleaning of the cylinder is effected, of course, in the same manner as the replacement of the cylinder described above. If the atomizer becomes clogged during operation, it will be sufficient to turn the cylinder 180° in order to effect atomization in the opposite direction and thus try to clear said atomizer. As can be noted from the drawing, the cylinder 19 has no blocked position and can turn 360° in its housing while being locked laterally by the grooves 38 and 39 of the front part 34 of the joint.

Changes and improvements can, of course, be made in the embodiment of the high-pressure spray nozzle which has just been described with reference to FIGS. 1 and 4. The joint being made of nylon or nylon reinforced with carbon fibers, could, for reasons of simplification, consist of a single piece. In this case, precautions will have to be taken upon the mounting of the nozzle. The user must see to it that the joint which is formed of a single piece is suitably positioned at the time that he screws the adapter 6 onto the diffusers 9 of the gun. Furthermore, the cylinder 19 can, of course, be replaced, for instance, by a ball, it being understood that the ball will have, on opposite sides of its spray channel, grooves similar to the grooves 26 and 27.

The tubular projections of the seat of the joint may have at its end a frustoconical part force-fitted in the front part of the joint and resting against an inner shoulder of the said front part.

In the foregoing, the present invention has been described in connection with illustrated embodiments thereof. Since many variations and modifications will be obvious to those skilled in the art, it is preferred that the scope of this invention be determined by the appended claims.

What is claimed is:

1. A spray nozzle particularly adapted for a spray gun, said nozzle comprising:

a central body, a rotary element placed within said central body; a channel traversing said rotary element, said channel having a spray orifice; a safety tip arranged in the front of said central body; a diffuser on said spray gun, said central body being connected to said diffuser;

a joint assuring tightness between the rotary element and said diffuser of said spray gun; and a bore in said central body corresponding to the channel of the spray orifice of the rotary element, said joint traversing said bore, said joint having a plurality of ribs; said rotary element having at least one circular groove whose axis corresponds to the axis of rotation of said rotary element and within which a corresponding rib of said joint is introduced, the front part of said joint having a cross-section of a shape corresponding to that of the bore of the central body, so that the joint is guided, positioned and held by said bore.

2. A nozzle according to claim 1, wherein the bore of the central body has a circular cross-section interrupted by two straight lateral portions which are parallel to each other, said joint having a front face portion which snugly rests gainst the rotary element and a front circular cross-section having two parallel lateral millings corresponding to the straight lateral portions of the central bore.

3. A nozzle according to claim 2, wherein the rotary element has two circular grooves which are parallel to each other and placed on opposite sides of the channel having the spray orifice, the joint having two corresponding ribs placed on opposite sides of the opening of its central bore, the two ribs forming an angle of 90° with the two lateral guide, positioning and holding millings of the joint.

4. A nozzle according to claim 1, wherein the rotary element is integral with a key intended to turn it within the central body.

5. A nozzle according to claim 1, wherein an adapter is interposed between the central body and the diffuser of the gun, the adapter being screwed onto the gun and having a tubular free portion introduced into the borehole of the central body which is screwed onto the adapter by means of a removable nut, the base of the joint being pressed against the gun by the adapter and the joint passing through the tubular part of the adapter and the bore of the central body so as to rest against the rotary element.

6. A nozzle according to claim 5, wherein the nozzle comprises a set of removable adapters, each having an inner thread corresponding to the different standardized threads of the existing guns.

7. A nozzle according to claim 5, wherein the joint is made in two parts which slide with respect to each other, tightness being assured by an O-ring placed between these two parts, one of the parts—the seat—being clamped between the adapter and the diffuser of the gun and the other part—the front part—sliding on a tubular projection of the seat and passing through a cylindrical portion of the adapter and the bore of the central body.

8. A nozzle according to claim 7, wherein the tubular projection of the seat of the joint has at its end a frustoconical part which is forced into the front part of the joint and rests against an inner shoulder of said front part.

9. A nozzle according to claim 7, wherein the tubular projection of the seat is integral with the seat.

10. A nozzle according to claim 7, wherein the tubular projection of the seat is a metal piece onto which the seat is applied.

11. A nozzle according to claim 7, wherein the tubular projection of the seat has grooves extending over about one-half of its front part.

12. A nozzle according to claim 1, wherein the spray orifice placed in the channel of the rotary element is machined in an atomizer which is in the form of a driven stud in the channel against a shoulder provided in said channel and held by a clamping ring.

13. A nozzle according to claim 4, wherein the nozzle comprises a set of rotary elements with its key, each element having a spray orifice defined by a predetermined rate of flow and angle of spray.

14. A nozzle according to claim 1, wherein the joint consists of plastic material.

15. A nozzle according to claim 10, wherein the seat of the joint is made of nylon reinforced with carbon fibers, the front part being of nylon.

16. A nozzle according to claim 1, wherein the rotary element is a cylinder.

17. A nozzle according to claim 1, wherein the connection between the central body of the nozzle and the diffuser of the spray gun is a screw threaded connection.

18. A nozzle according to claim 5, wherein the adapter is removable and has an inner thread corresponding to any one of different standardized threads of existing guns.

19. A nozzle according to claim 4, wherein the rotary element is removable and has a spray orifice of a predetermined rate of flow and angle of spray.

* * * * *